US008632038B2

(12) United States Patent
Christian et al.

(10) Patent No.: US 8,632,038 B2
(45) Date of Patent: Jan. 21, 2014

(54) METHOD AND APPARATUS FOR ADJUSTING HEIGHTS OF OBJECTS

(75) Inventors: Steven Lee Christian, Houston, TX (US); Michael S Maize, Houston, TX (US)

(73) Assignee: Table Jacks, LLC, Houston, TX (US)

( * ) Notice: Subject to any disclaimer, the term of this patent is extended or adjusted under 35 U.S.C. 154(b) by 2058 days.

(21) Appl. No.: 11/546,649

(22) Filed: Oct. 12, 2006

(65) Prior Publication Data

US 2008/0087777 A1 Apr. 17, 2008

(51) Int. Cl.
*F16M 11/24* (2006.01)

(52) U.S. Cl.
USPC ..... 248/188.2; 248/188.4; 248/188.8; 248/188.9; 248/188.5; 108/147; 108/144.11

(58) Field of Classification Search
USPC ..... 248/188.2, 188.4, 188.8, 188.9, 188.5; 108/147, 144.11
See application file for complete search history.

(56) References Cited

U.S. PATENT DOCUMENTS

| | | | | |
|---|---|---|---|---|
| 6,302,543 | B1 * | 10/2001 | Arai et al. | 353/70 |
| 6,523,799 | B2 * | 2/2003 | Su | 248/404 |
| 6,663,060 | B1 * | 12/2003 | Gifford, Sr. | 248/161 |
| 6,871,826 | B2 * | 3/2005 | Oyama et al. | 248/188.8 |
| 7,086,631 | B2 * | 8/2006 | Lee et al. | 248/161 |
| 7,178,768 | B2 * | 2/2007 | Inoue | 248/188.4 |
| 7,198,238 | B2 * | 4/2007 | Inoue | 248/188.4 |
| 7,467,769 | B2 * | 12/2008 | Shao et al. | 248/188.2 |
| 7,498,236 | B2 * | 3/2009 | Codding et al. | 438/459 |

* cited by examiner

*Primary Examiner* — Terrell McKinnon
*Assistant Examiner* — Michael McDuffie
(74) *Attorney, Agent, or Firm* — Philip S. Lyren

(57) ABSTRACT

Embodiments include methods and apparatus for adjusting heights of objects. One embodiment is a leg adjusting assembly that has a housing connected to a leg of a table. A foot mechanism extends outwardly from the housing and from the leg. When a force is applied to the foot mechanism with a foot of a user, a rod vertically moves in the housing and adjusts a height of the table.

14 Claims, 7 Drawing Sheets

METHOD AND APPARATUS FOR ADJUSTING HEIGHTS OF OBJECTS

BACKGROUND

Tables and chairs are designed to be placed on level surfaces. When the legs of such devices are positioned on flat surfaces, the seating surface of the chair or surface of the table is level. In this level position, tables and chairs are sturdy and not prone to wobble. By contrast, when the legs of such devices are positioned on uneven surfaces, the seating surface of the chair or surface of the table is not level. Here, tables and chairs can wobble, become unsteady, and even fall over.

Wobbling tables and chairs can negatively impact the success of a business. In the restaurant and entertainment industry, uneven tables and chairs can inconvenience and annoy customers. In a restaurant, some customers will refuse to eat at a wobbling table and request another table. If the restaurant cannot provide a sturdy table, then customers may have an unpleasant experience and not return or even leave before eating. Further, if the table cannot be leveled, then it may be removed from the eating area and thus reduce the seating capacity and profit for the restaurant.

In many instances, employees or even customers of a restaurant use one of a variety of techniques to manually level wobbling tables and chairs. Sometimes customers wedge an object, such as folded paper or napkins, under the leg of the table in an attempt to level the table. This option is a quick-fix and often does not work since the object compresses or will not remain lodged under the leg. Even if the table is leveled with such an object, the table can become uneven again as soon as the table is moved or the object dislodges from the leg. Further, when objects are jammed under the legs, the tables and chairs present an unprofessional appearance that does not encourage repeat customers.

Wobbling tables and chairs present numerous other inconveniences as well. Users can fall out of an unstable chair and become injured. Further, businesses can lose significant profit if employees spend time repeatedly attempting to adjust a table or chair on an uneven surface.

SUMMARY

Embodiments include methods and apparatus for adjusting heights of objects. One embodiment is a leg adjusting assembly that has a housing connected to a leg of a table. A foot mechanism extends outwardly from the housing and from the leg. When a force is applied to the foot mechanism with a foot of a user, a rod vertically moves in the housing and adjusts a height of the table.

Another embodiment includes a method for adjusting a height of a table. The method includes attaching a leg adjusting assembly to a cavity formed in a leg of the table; extending a lever outwardly from the leg; and biasing the lever against a movable rod such that a force applied by a foot of a user to an end of the lever disengages the lever from the rod and enables a user to adjust the height of the table.

Other embodiments and variations of these embodiments are shown and taught in the accompanying drawings and detailed description.

DETAILED DESCRIPTION

Embodiments in accordance with the invention are directed to methods and apparatus for adjusting the heights of objects. One exemplary embodiment includes a leg adjusting assembly that attaches to a bottom portion of a leg of a table, chair, or other movable object. The leg adjusting assembly enables a user to easily adjust or alter a height of one or more legs. When the legs of such devices are positioned on an uneven surface, the seating surface of the chair or surface of the table is readily leveled with a foot of a user. In this level position, tables and chairs are sturdy and not prone to wobble or fall over.

In one exemplary embodiment, the leg adjusting assembly attaches to a leg or bottom surface of a table or chair and includes a foot mechanism that extends outwardly from a housing. When the foot mechanism is actuated (example, depressed with a foot of a user), the leg adjusting assembly vertically moves upwardly or downwardly. This vertical movement causes the leg to vertically move with respect to a surface (such as the floor or ground). Since the position of one or more legs is vertically movable with respect to the supporting surface, users are able to adjust the height (i.e., level) tables and chairs that rest on a variety of uneven surfaces.

In one exemplary embodiment, the leg adjusting assembly is activated with only the foot of a user. Users are not required to bend down to activate the leg adjusting assembly and level a table or chair. Instead, the legs of objects are adjusted while the user is standing. Further, the leg adjusting assembly provides a relatively wide range of vertical motion so objects can be leveled on a wide variety of uneven surfaces. In one embodiment for instance, the leg adjusting assembly enables a leg to vertically move up to an infinite number of adjustable positions that range up to about one inch or more. In another exemplary embodiment, the leg adjusting assembly enables the leg to vertically move up distances greater than about one inch, such as two inches, three inches, etc.

Exemplary embodiments are easy to use and install. The leg adjusting assembly can be retrofit to attach to legs having different shapes and sizes. Users can thus separately install the leg adjusting assembly onto existing devices, such as existing tables and chairs. In other exemplary embodiments, the leg adjusting assemblies are integrally formed onto one or more legs of the device. For instance, the leg adjusting assemblies are permanently attached or connected to one or more legs during manufacturing or assembly.

Embodiments in accordance with the invention are applicable to a wide variety of objects including, but not limited, to movable objects, such as tables, chairs, appliances, and the like. For illustration purposes, exemplary embodiments are shown in conjunction with tables and chairs, but embodiments include various objects and device that are movable and/or require a level surface.

Figure 1:
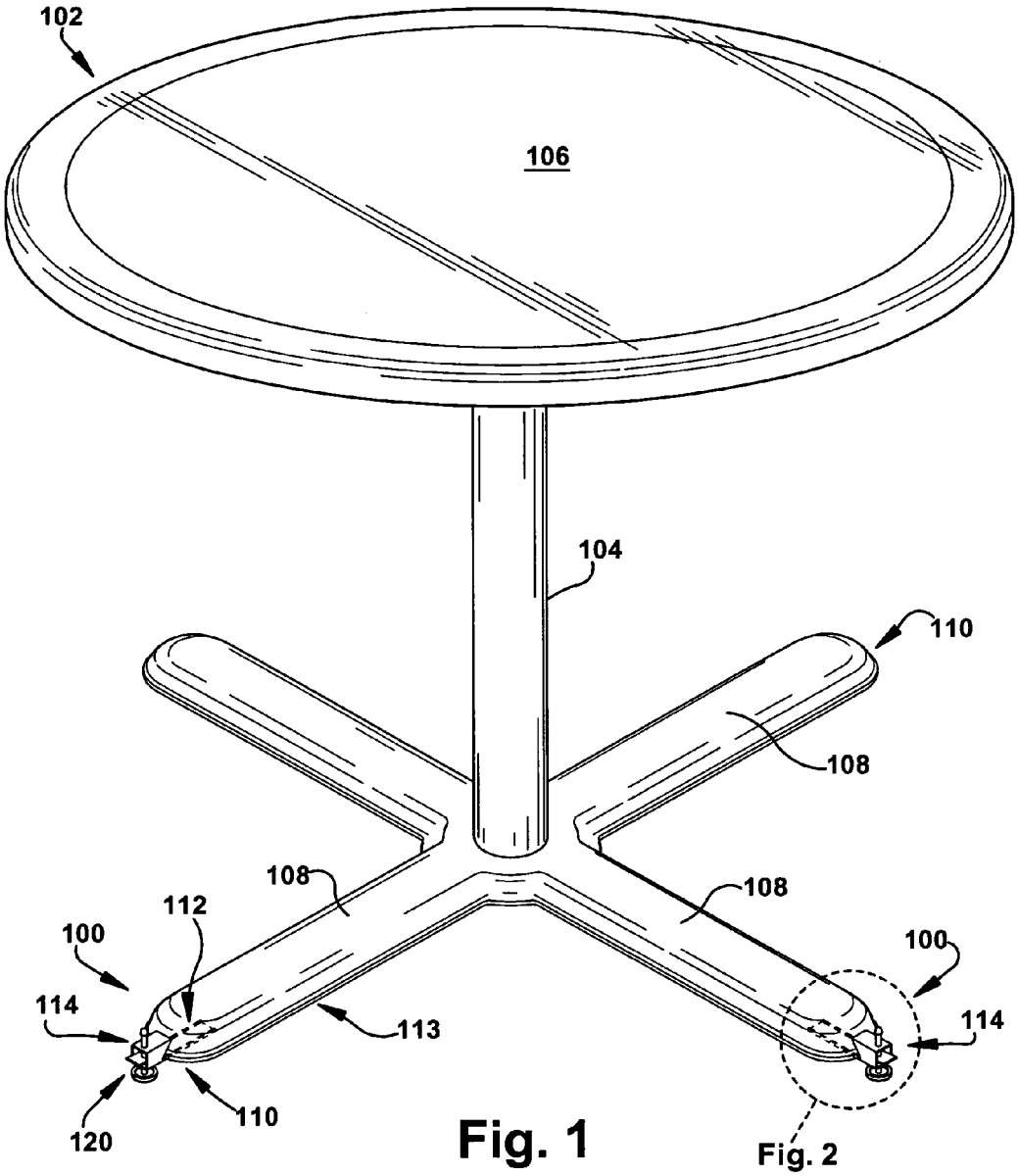
FIG. 1 is a perspective view of a table having plural leg adjusting assemblies in accordance with an exemplary embodiment of the invention.

FIG. 1 is a perspective view of plural leg adjusting assemblies 100 attached to a table 102 in accordance with an exemplary embodiment of the invention. The table 102 includes a central post 104 having a first end connected to a table top 106 and a second end connected to a plurality of legs 108, with four legs being shown. The legs extend from the central post 104 to a distal portion or end 110.

As shown, each leg adjusting assembly 100 is attached and connected to the distal portion 110 of a corresponding leg 108. A first portion 112 of a leg adjusting assembly 100 connects to an underside 113 of a leg, and a second portion 114 extends outwardly from the distal portion 110. This outwardly extending portion 114 includes a foot mechanism 120 that is activated with pressure from the foot of a user.

Figure 2:
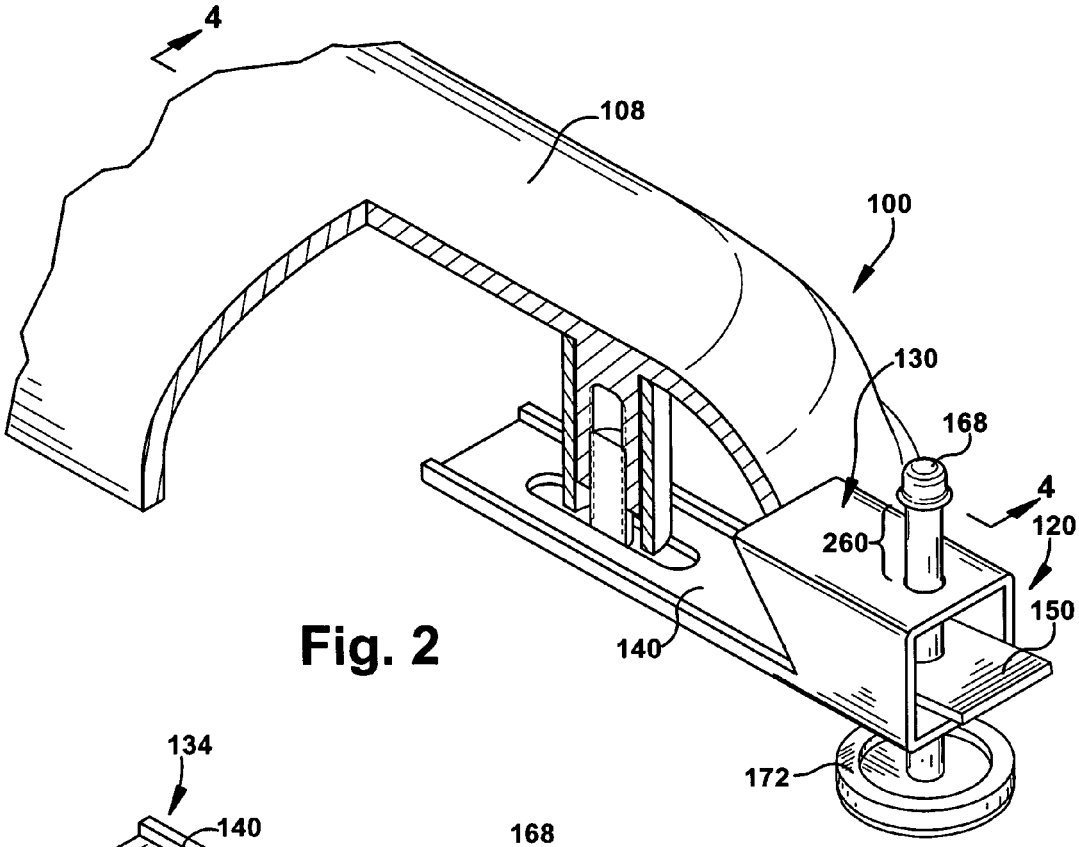
FIG. 2 is an enlarged partial cross-sectional view taken along a dashed circle of FIG. 1 showing a leg adjusting assembly attached to a leg in accordance with an exemplary embodiment of the invention.
Figure 3:
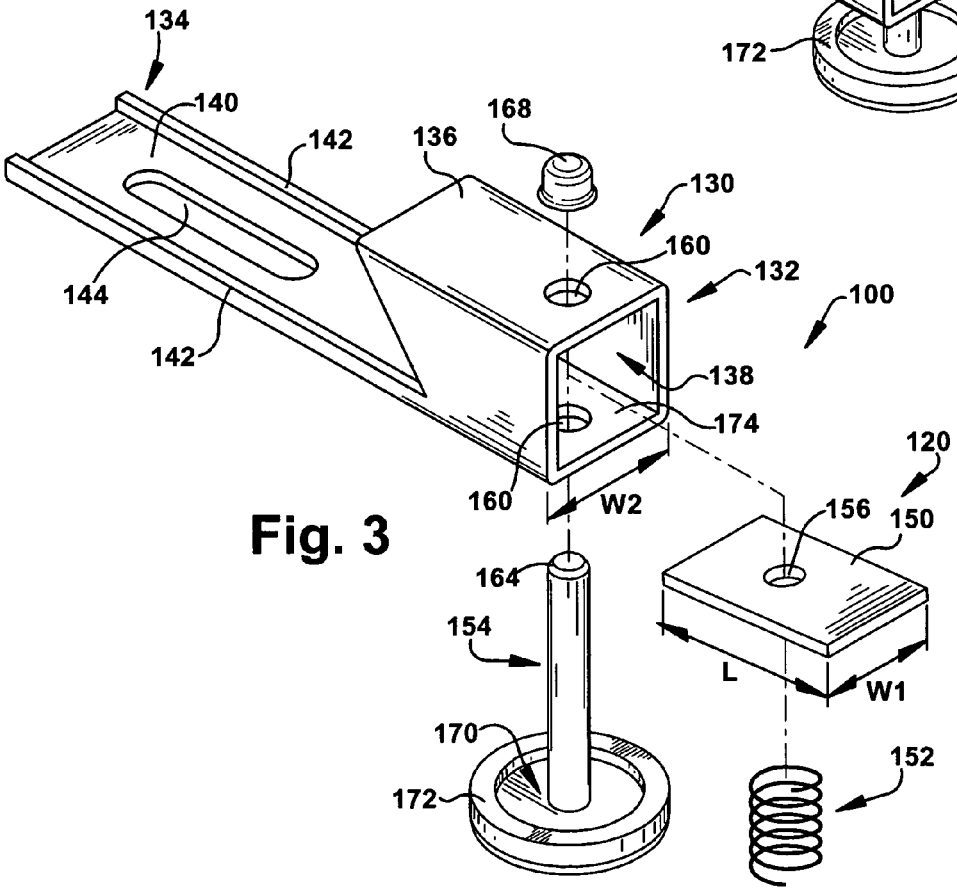
FIG. 3 is an exploded view of a leg adjusting assembly in accordance with an exemplary embodiment of the invention.

FIG. 2 is an enlarged partial cross-sectional view taken along a dashed circle of FIG. 1 showing one leg adjusting assembly 100 attached to one of the legs 108 of table 102 in accordance with an exemplary embodiment of the invention. FIG. 3 shows an exploded view of this leg adjusting assembly 100 in accordance with an exemplary embodiment of the invention.

Looking to FIGS. 2 and 3, the leg adjusting assembly 100 generally includes the foot mechanism 120 and a housing 130. The housing extends from a first end 132 to a second end 134. The first end 132 includes a rectangular or square shaped structure 136 having a cavity 138 formed therein. In one exemplary embodiment, this cavity 138 extends through the entire structure 136. The second end 134 includes an elongated flat support 140. The support 140 has a rectangular shape and includes two parallel, spaced apart ridges 142 that extend lengthwise along an outer periphery of the support. An elongated opening or slot 144 extends along a portion of the support 140 between the two ridges 142. In one exemplary embodiment, the opening 144 has an elongated rectangular shape with rounded ends.

The foot mechanism includes or cooperates with a lever 150, a biasing member 152, and an elongated cylindrical rod 154. These elements fit fully or at least partially into the cavity 138 of structure 136.

The lever 150 has a flat rectangular shape having a length L and width W1. This width W1 is slightly smaller than a width W2 of the opening to cavity 138 so the lever can freely move into and out of the cavity 138. In one exemplary embodiment, the lever includes an opening 156 centrally located about the width W1 of the body of the lever 150.

In one exemplary embodiment, the rod 154 has a size and shape to fit through the opening 156 in the lever 150 and two openings 160 formed in the structure 136. A first end 164 of the rod 154 extends completely through the cavity 138 and projects outwardly from a top surface of the housing 130. A cylindrical cap 168 fits on the first end 164 of the rod. The cap prevents the rod from falling through the openings 160 and out of housing 130.

A second end 170 of the rod 154 includes a glide 172. This glide is adapted to seat against a surface, such as a floor. In one exemplary embodiment, the glide 172 has disk-shape that is substantially larger than the openings 160. Thus, when cap 168 is attached to the first end 164 and the glide 172 is attached to the second end 172, the rod is captured in the housing 130.

In order to assemble the leg adjusting assembly 100, one end of the lever 150 is positioned into the cavity 138 until the opening 156 concentrically aligns with the two openings 160 formed in housing 130. The biasing member aligns with openings 156 and 160 and is positioned inside the cavity 138 between the lever 150 and a bottom surface 174 of housing 130. In one exemplary embodiment, the biasing member 152 is shown as a helical or coiled spring, but it may have various configurations. First end 164 of rod 154 passes through bottom opening 160, through biasing member 152, through opening 156, and finally through top opening 160 until the first end 164 protrudes above a top surface of housing 130. Cap 168 is attached (example, press fit or screwed) onto first end 164 to maintain rod 154 inside cavity 138.

Leg adjusting assemblies 100 in accordance with exemplary embodiments can be adapted to attach or connect to a wide variety of objects. The specific connection mechanisms utilized to connect a leg adjusting assembly to such an object will depend, in part, on the design of the leg. By way of example, FIGS. 4 and 5 are side views showing the leg adjusting assembly 100 connected to a leg of such an object.

As shown, support 140 attaches to an underside 200 of leg 108. By way of example, the leg 108 includes a cavity 202 and a cylindrical projection 204 extending downwardly inside cavity 202 and from an underside surface 206 of leg 108. A bushing or spacer 210 fits around an exterior of the projection 204 and extends between the surface 206 and support 140.

In order to attach the leg adjusting assembly 100 to the leg 108, the support 140 slides under the leg 108 until a canted surface 212 of housing 130 abuts against an exterior end portion 214 of leg 108. Opening 144 in support 140 aligns with concentric openings 216 in both the projection 204 and bushing 210 (see also FIGS. 2 and 3). In one exemplary embodiment, projection 204 includes a threaded interior that receives a threaded end of a screw 220.

Figure 4:
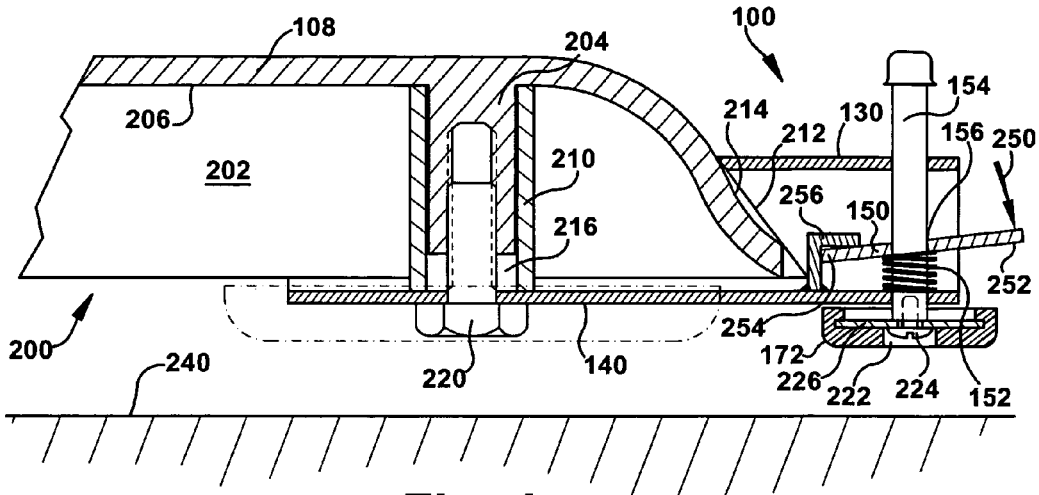
FIG. 4 is a side view taken along lines 4-4 of FIG. 2 showing a leg adjusting assembly in a contracted position in accordance with an exemplary embodiment of the invention.
Figure 5:
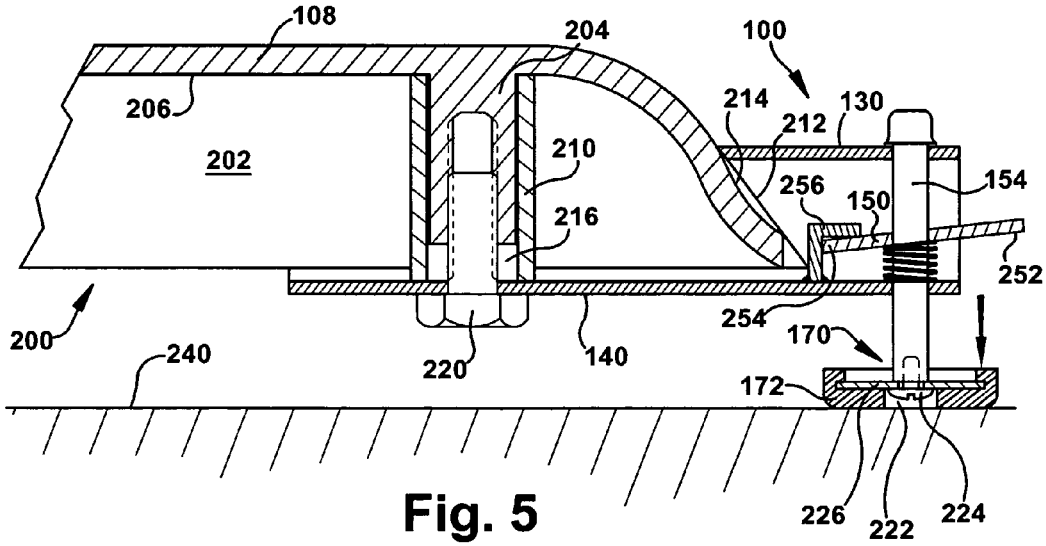
FIG. 5 is a view side taken along line 4-4 of FIG. 2 showing a leg adjusting assembly in an extended position in accordance with an exemplary embodiment of the invention.

As shown best in FIGS. 4 and 5, glide 172 includes a central opening 222 for receiving a screw 224. This screw passes through opening 222 and threadably engages with interior threads located in a hollow portion of second end 170 of rod 154. The screw 224 is threaded to abut against a plate or surface 226.

As shown, the leg adjusting assembly 100 removably connects to a leg 108. Although a screw is used to connect the leg adjusting assembly to the leg, one skilled in the art will appreciate that various mechanisms are within exemplary embodiments of the invention.

FIG. 4 shows an example embodiment wherein the leg 108 is positioned off from a surface 240. In this position, the leg adjusting assembly 100 is in a contracted state or position. This situation occurs, for example, when the table 102 (FIG. 1) is not level (example, the surface 240 is uneven or not flat). In this instance, if the leg were not corrected then the table or corresponding object attached to the leg 108 would not be sturdy and prone to wobble or fall over.

The leg adjusting assembly 100 is easily adjustable so the leg can be quickly leveled with the surface 240. Specifically, a downward force, shown at arrow 250, is applied to one end 252 of lever 150. This force (example, from a foot of a user) causes the end 252 to rotate downwardly and opening 156 to move along rod 154. A second end 254 of lever 150 abuts against a stop or wall 256 and prevents end 254 from moving. As the end 252 moves, the lever 150 disengages from rod 154. This disengagement enables rod 154 to fall downwardly toward surface 240 until glide 172 abuts the surface (see FIG. 5).

The rod 154 is thus able to slide or move vertically within housing 130. This movement enables a user to adjust the position of glide 172 and ultimately adjust the vertical height of leg 108.

In one exemplary embodiment, the length of the rod dictates the amount of vertical adjustability for the leg. More specifically, the rod has a portion 260 (see FIG. 2) that extends above the housing 130. A length of this portion determines the vertical height for raising the leg from the surface 240. In one exemplary embodiment, this portion 260 has a length less than about one inch to three-quarters of an inch.

Once the downward force 250 is released from the lever 150, the biasing member 152 forces or biases the lever 150 upwardly. More specifically, end 252 moves upwardly until interior walls of opening 156 pinch or contact an exterior or outer surface of rod 154. The biasing member 152 functions to wedge lever 150 against the rod 154 so the rod is not capable of vertically moving.

Exemplary embodiments can be modified to include a wide variety of alternate embodiments. FIGS. 6-10 illustrate some of these alternate embodiments.

Figure 6:
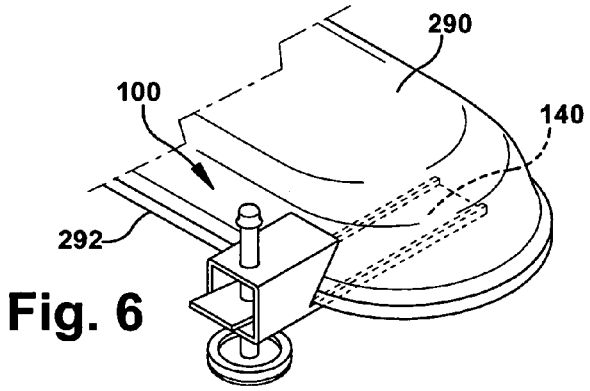
FIG. 6 is a perspective view showing a leg adjusting assembly attached to a leg in accordance with another exemplary embodiment of the invention.

FIG. 6 is a perspective view showing a leg adjusting assembly 100 attached to a leg 290 in accordance with another exemplary embodiment of the invention. In this embodiment, the leg adjusting assembly 100 connects to a side 292 of leg 290. Specifically, support 140 extends under the leg along a side of the leg.

The embodiment shown in FIG. 6 illustrates that the leg adjusting assembly 100 can be positioned around or at various locations on a leg. Such locations include, but are not limited to, an end of the leg, along a side of a leg, and/or fully or partially within a cavity formed in the leg.

Figure 7:
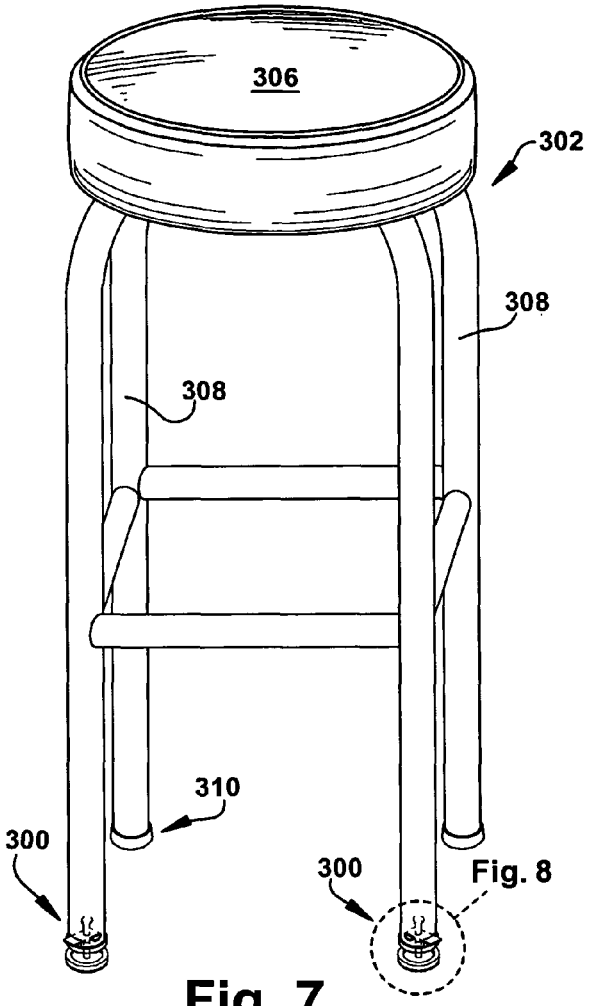
FIG. 7 is a perspective view of a stool having plural leg adjusting assemblies in accordance with an exemplary embodiment of the invention.

FIG. 7 is a perspective view of plural leg adjusting assemblies 300 attached to a chair 302 in accordance with an exemplary embodiment of the invention. The chair 302 includes a seating surface 306 and a plurality of legs 308 with four legs being shown. The legs extend from the seating surface 306 to a distal portion or end 310.

Figure 9:
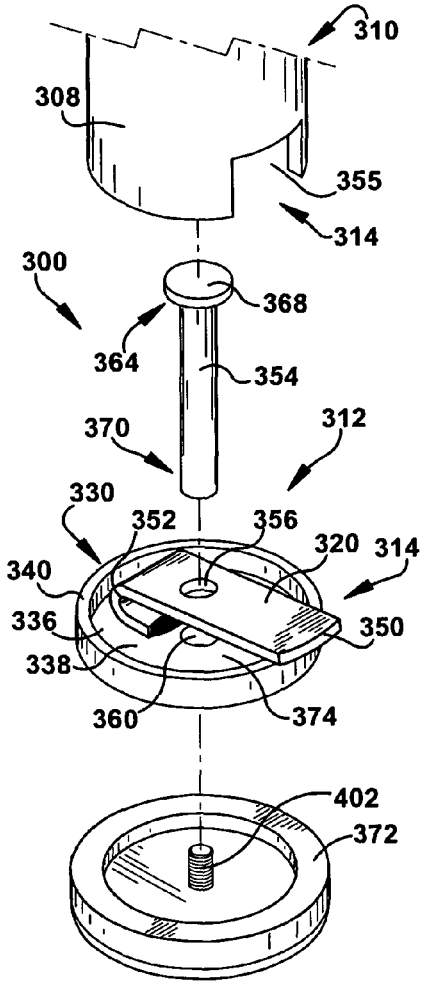
FIG. 9 is an enlarged exploded view taken along lines 9-9 of FIG. 8 showing a leg adjusting assembly in accordance with an exemplary embodiment of the invention.
Figure 8:
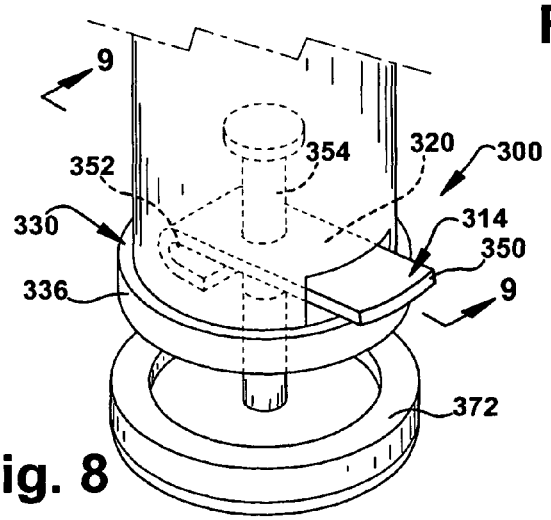
FIG. 8 is an enlarged view taken along a dashed circle of FIG. 7 showing a leg adjusting assembly in accordance with an exemplary embodiment of the invention.

Looking to FIGS. 7-9, each leg adjusting assembly 300 is attached and connected to the distal portion 310 of a corresponding leg 308. A first portion 312 of a leg adjusting assembly 300 connects to an underside or bottom side 314 of a leg, and a second portion 314 extends outwardly from the distal portion 310. This outwardly extending portion 314 includes a foot mechanism 320 that is activated with pressure from the foot of a user.

The leg adjusting assembly 300 generally includes the foot mechanism 320 and a housing 330. In one exemplary embodiment, the housing has a disk-shaped or cylindrical shaped structure 336 having a cavity 338 formed therein. In one exemplary embodiment, this cavity 338 is cylindrical and is formed within an outer or peripheral wall 340.

The foot mechanism includes and/or cooperates with a lever 350, a biasing member 352, and an elongated cylindrical rod 354. These elements fit fully or at least partially into the cavity 338 of structure 336.

The lever 350 has a flat rectangular shape having a length and width. This width is slightly smaller than a width of an opening (such as a slot) 355 formed in the end of leg 308. In one exemplary embodiment, the lever includes an opening 356 centrally located about the width of the body of the lever 350.

In one exemplary embodiment, the rod 354 has a size and shape to fit through the opening 356 in the lever 350 and another opening 360 formed in the structure 336. A first end 364 of the rod 354 extends completely through the cavity 338 and projects outwardly from a top surface of the housing 330. A cylindrical cap or head 368 is formed or fits on the first end 364 of the rod. The cap prevents the rod from falling through the openings 356 and 360 and out of housing 330.

A second end 370 of the rod 354 includes a glide 372. This glide is adapted to seat against a surface, such as a floor. In one exemplary embodiment, the glide 372 has disk-shape that is substantially larger than the openings 360. Thus, the head 368 and glide 372 capture the rod within housing 330.

In one exemplary embodiment, the lever 350 and the biasing member 352 are integrally formed together. In other words, the lever and biasing member form a single, one-piece unit.

In order to assemble the leg adjusting assembly 300, one end of the lever 350 is positioned into the cavity 338 until the opening 356 concentrically aligns with the opening 360 formed in housing 330. The biasing member is positioned inside the cavity 338 between the lever 350 and a bottom surface 374 of housing 330. In one exemplary embodiment, the biasing member 352 is shown as a bent or rounded portion of the lever that provides resilience and biasing. Second end 370 of rod 354 passes through opening 356 in biasing member 352 and through opening 360 until head 368 abuts or contacts lever 350 at opening 356.

Leg adjusting assemblies 300 in accordance with exemplary embodiment can be adapted to attach or connect to a wide variety of objects. The specific connection mechanisms utilized to connect a leg adjusting assembly to such an object will depend, in part, on the design of the leg.

Figure 10:
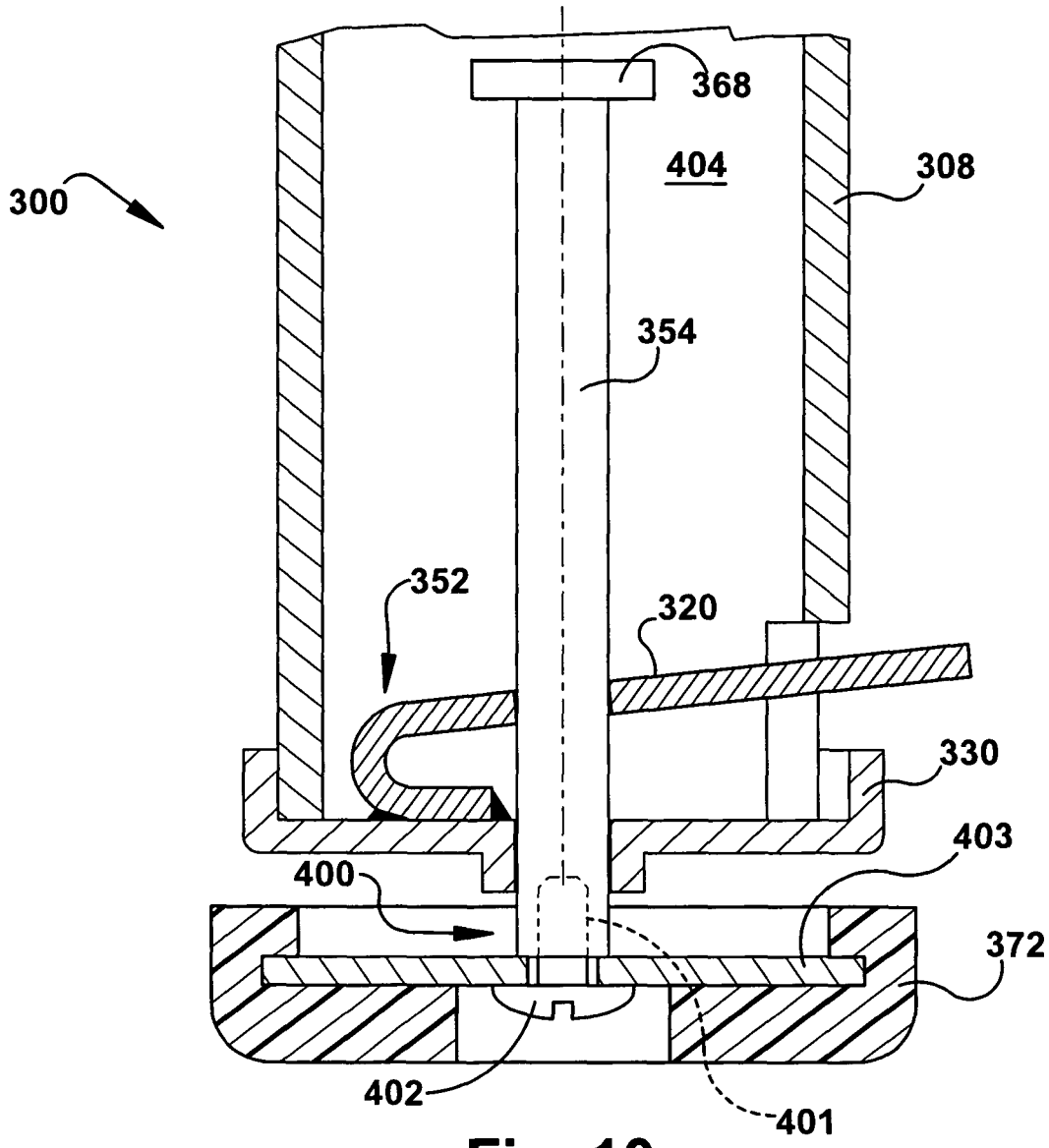
FIG. 10 is an enlarged side view of a leg adjusting assembly connected to a leg in accordance with an exemplary embodiment of the invention.

As shown in FIGS. 8-10, rod 354 has a hollow end 400 that includes a threaded recess 401. This threaded recess threadably connects to a threaded screw 402 that extends upwardly from a center of glide 372 until a head of the screw abuts against a plate or stop 403. In this manner, the leg adjusting assembly 300 attaches to an underside or bottom of leg 308. By way of example, the leg 308 includes a cavity 404 formed in the end of the leg. This cavity is sized and shaped to receive and house head 368 and portions of at least housing 330, rod 354, foot mechanism 320, and biasing member 352. By way of example, housing 330 permanently or removably attaches to the end of leg 308 (best shown in FIG. 10). The glide 372 removably threads to the bottom surface of housing 330 so the glide can be replaced if it becomes worn or damaged. Alternatively, the glide 372 can be integrally formed with or to the leg adjusting assembly 300. The leg adjusting assembly 300 is easily adjustable in a similar manner as discussed in connection with FIGS. 4 and 5.

Figure 11:
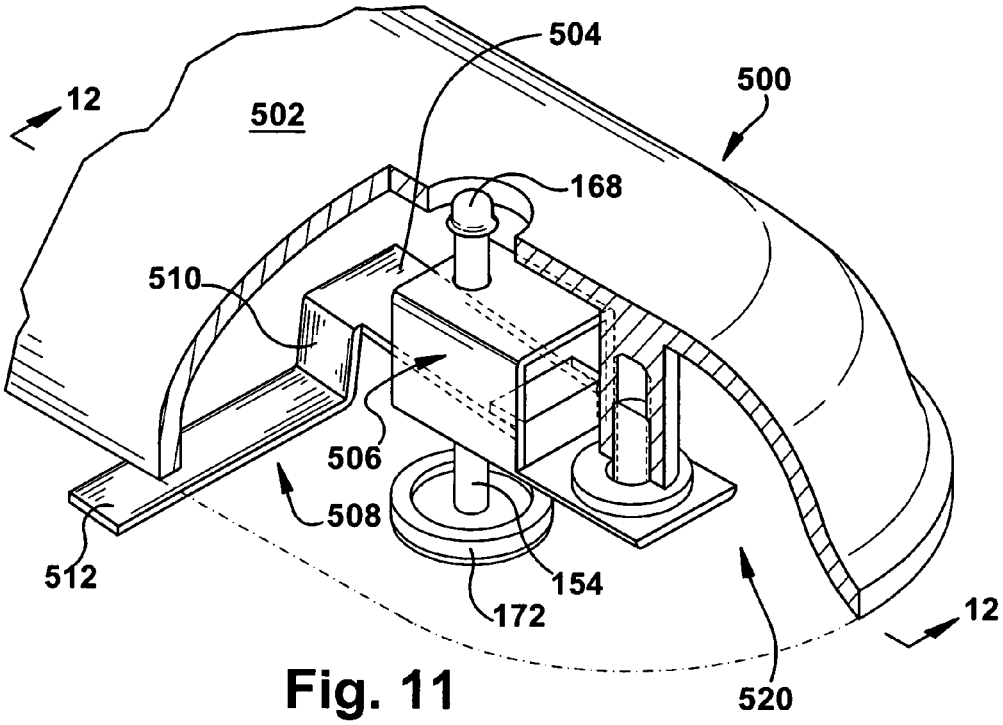
FIG. 11 is a partial cross-sectional view showing a leg adjusting assembly attached to a leg in accordance with another exemplary embodiment of the invention.
Figure 12:
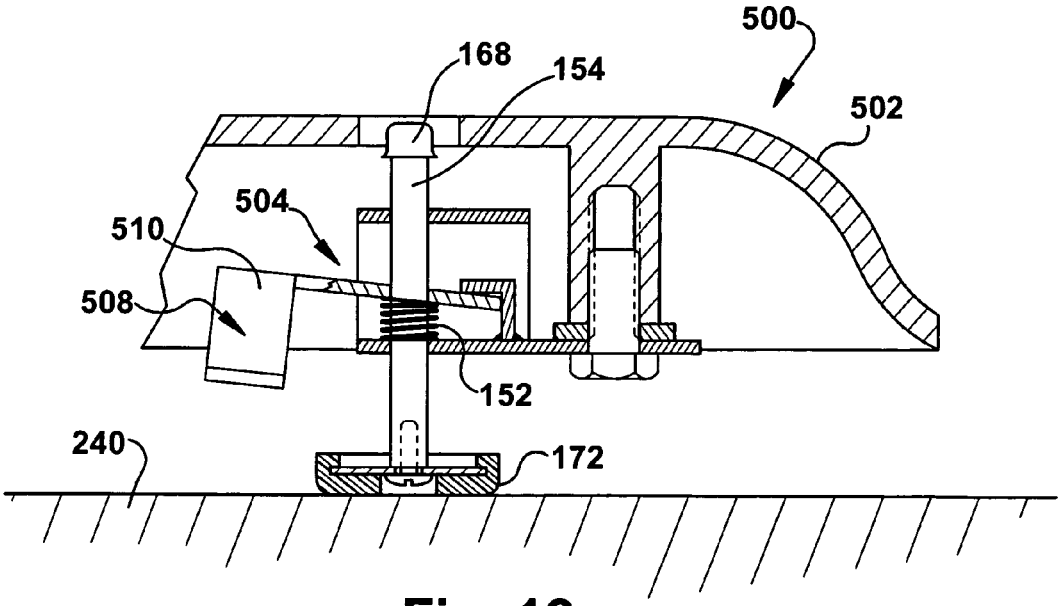
FIG. 12 is a side view taken along lines 12-12 of FIG. 11 showing a leg adjusting assembly in an extended position in accordance with an exemplary embodiment of the invention.

FIGS. 11 and 12 show a leg adjusting assembly 500 attached to a leg 502 in accordance with another exemplary embodiment of the invention. In this embodiment, the leg adjusting assembly 500 is similarly configured to the leg adjusting assembly discussed in connection with FIGS. 1-6 (with common components having identical numbers and some differences being discussed hereafter).

As one difference, the support 504 has an L-shape that includes a first portion 506 (similar to support 140 discussed in FIGS. 2 and 3) and a second portion 508. A bridge portion 510 connects the first and second portions such that the second portion is vertically lower than the first portion.

In one exemplary embodiment, the second portion 508 has an elongated rectangular shape with an end 512 that extends outwardly from a side of leg 502. When a downward force is applied to the second portion, the rod 154 is vertically movable as discussed in connection with FIGS. 4 and 5.

As another difference, the leg adjusting assembly 500 is fully positioned or enclosed within a cavity 520 formed on the underside or end of leg 502. Only the second portion 508 extends outwardly from an exterior surface of the leg. This second portion functions as the foot mechanism to enable users to raise and lower the height of the leg.

Figure 13:
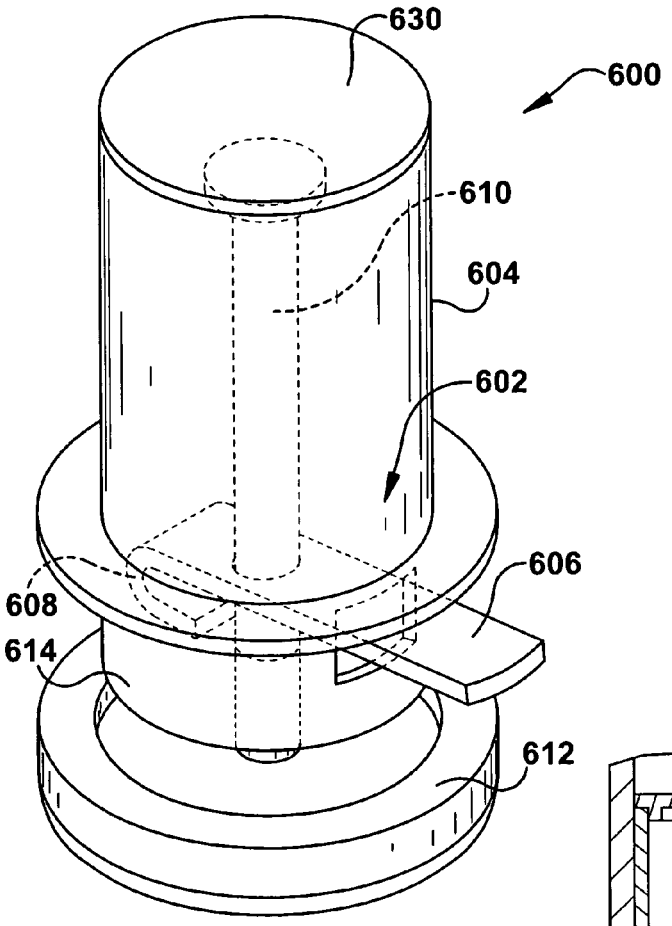
FIG. 13 is a perspective view showing another leg adjusting assembly in accordance with another exemplary embodiment of the invention.
Figure 14:
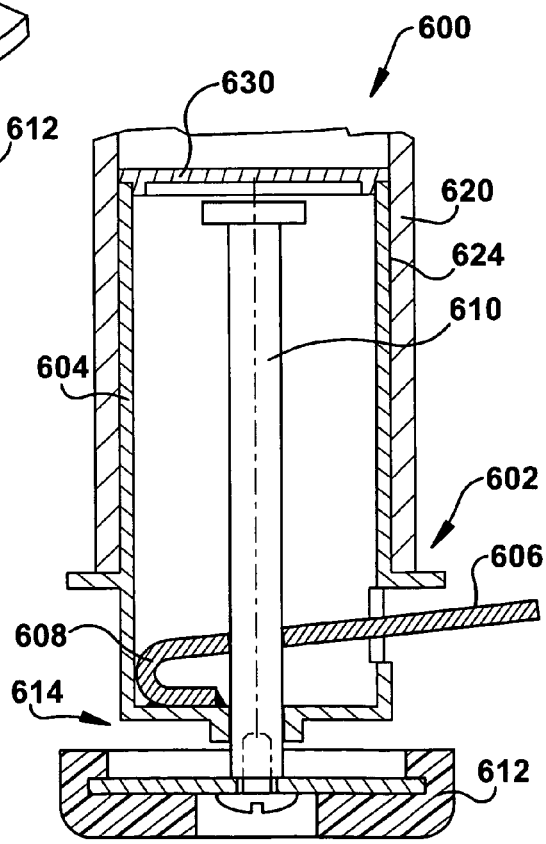
FIG. 14 is a cross-sectional view showing of the leg adjusting assembly of FIG. 13 in accordance with another exemplary embodiment of the invention.

FIGS. 13 and 14 show showing another leg adjusting assembly 600 in accordance with another exemplary embodiment of the invention. In this embodiment, the foot mechanism 602 is enclosed within a housing 604. The housing extends around or encloses lever 606, biasing member 608, and rod 610 and protects mechanical parts of the leg adjusting assembly.

In one exemplary embodiment, the housing 604 is shaped as an elongated cylinder having a sufficient length so the rod 610 can freely move in a vertical direction from the contracted to expanded positions (discussed in connection with FIGS. 4 and 5). The rod moves entirely within the housing. By way of illustration, FIG. 14 shows the leg adjusting assembly in a contracted position with the glide 612 being adjacent a bottom portion 614 of housing 604.

The leg adjusting assembly 600 can attach to legs and objects in a variety of ways. By way of example, a leg 620 (FIG. 4) includes a cavity 624 that is sized and shaped to receive house 604. In another exemplary embodiment, the leg does not include a cavity. Instead, the leg adjusting assembly 600 attaches to a bottom surface of the leg. For example, a top portion 630 of housing 604 abuts against a bottom portion (example, the portion contacting a surface or ground) in order to connect the leg adjusting assembly to a leg or object. Various attachment mechanisms and methods (such as glue, screws, pins, nails, etc.) can be used to attach the housing to an undersurface of a leg or object.

The leg assemblies in accordance with the invention can be fabricated from a variety of materials including, but not limited to, metals, plastics or polymers, and combinations thereof, to name a few examples. Further, embodiments in accordance with the present invention can utilize a modular connective architecture. If a particular component within the leg adjusting assembly fails or otherwise needs to be replaced, the component can be removed from the assembly and replaced with a new and/or different component. As such, the assemblies can be constructed with standardized components and/or dimensions to enable flexibility and variety of uses in different legs and exchanges of components. Further yet, the leg adjusting assemblies can be retrofit or attached to legs after manufacture of the legs. Alternatively, the leg adjusting assemblies are permanently or removably attached to one or more legs during manufacturing or during assembly.

One skilled in the art will appreciate that a discussion of various methods of using, constructing, replacing, altering, or attaching the leg adjusting assemblies should not be construed as steps that must proceed in a particular order. Instead, while the invention has been disclosed with respect to a limited number of embodiments, those skilled in the art will appreciate, upon reading this disclosure, numerous modifications and variations. It is intended that the appended claims cover such modifications and variations and fall within the true spirit and scope of the invention.

What is claimed is:

1. A leg adjusting assembly, comprising: a housing connected to a leg of a table; a rod having an exterior surface and being vertically movable within the housing; a foot mechanism having a hole with an interior wall and extending outwardly from the housing; and a biasing member wedging the interior wall of the hole against the exterior surface of the rod to prevent the rod from moving during absence of a force applied to the foot mechanism, wherein the foot mechanism has a rectangular shape with an opening for slidably receiving the rod.

2. The leg adjusting assembly of claim 1, wherein the force applied to the foot mechanism with a foot of a user causes the interior wall of the hole to disengage from the exterior surface of the rod and enable the rod to vertically move within the hole to adjust a height of the table.

3. The leg adjusting assembly of claim 1, wherein the housing has a rectangular shape with two openings for slidably receiving the rod.

4. The leg adjusting assembly of claim 1 further comprising: a disk-shaped glide that removably attaches to one end of the rod and abuts against a surface on which the leg is positioned.

5. The leg adjusting assembly of claim 1, wherein:

the foot mechanism includes a rectangular shaped lever;

the biasing member is a coiled spring that is positioned around the rod and captured between the lever and the housing.

6. The leg adjusting assembly of claim 1, wherein the housing has (1) a first portion with a rectangular configuration forming a cavity for receiving the rod and a portion of the foot mechanism and (2) a second portion having an elongated shape for attaching to the leg.

7. A method for adjusting a height of a table, comprising:

attaching a leg adjusting assembly to a cavity formed in a leg of the table;

extending a lever outwardly from the leg; and biasing an interior wall of a hole in the lever against an outer surface of a movable rod to pinch the rod and prevent the rod from moving within the hole, wherein a force applied by a foot of a user to an end of the lever disengages the interior wall of the hole from the outer surface of the rod and enables a user to adjust a height of the table.

8. The method of claim 7 further comprising: moving the rod inside the cavity to adjust the height of the table.

9. The method of claim 7 further comprising:

attaching a glide to an end of the rod;

adjusting a length of the rod that extends within the cavity of the leg in order to move a position of the glide and adjust the height of the table.

10. The method of claim 7 further comprising: moving the rod within the cavity in a vertical direction with respect to a surface on which the table is positioned in order to adjust the height of the table.

11. The method of claim 7 further comprising:

moving the rod within the cavity while the force is applied to the lever;

re-engaging the lever against the rod when the force is removed from the lever.

12. A leg adjusting assembly, comprising: a housing abutting a leg of a table; a rod movable within the housing; a lever having a first end positioned in the housing, a second end extending outwardly from the housing and the leg of the table, and a hole with an interior surface; and a biasing member that moves the lever against the rod until the interior surface wedges against an exterior surface of the rod and prevents the rod from moving within the housing, wherein a foot activated force applied to the second end disengages the interior surface of the hole from the exterior surface of the rod to alter a height of the table, wherein the lever has a flat rectangular shape with the hole being centrally located in the lever.

13. The leg adjusting assembly of claim 12, wherein:

the rod has an elongated cylindrical shape;

the biasing member is a helical spring;

the lever is a rectangular plate with the hole extending through the plate.

14. The leg adjusting assembly of claim 12 further comprising: a glide threadably attached to one end of the rod, the glide being positioned on a surface that supports the table.

* * * * *